United States Patent [19]

Bossetti

[11] Patent Number: 4,539,919

[45] Date of Patent: Sep. 10, 1985

[54] SUPPORTING STRUCTURES FOR FURNACE CROWNS

[75] Inventor: Renato Bossetti, Novara, Italy

[73] Assignee: S.I.T.I. Società Impianti Termoelettrici Industriali S.p.A., Marano Ticino, Italy

[21] Appl. No.: 624,516

[22] Filed: Jun. 25, 1984

[30] Foreign Application Priority Data

Jul. 14, 1983 [IT] Italy ..... 22362/83[U]

[51] Int. Cl.[3] ..... F23M 5/06

[52] U.S. Cl. ..... 110/331; 110/332; 432/247

[58] Field of Search ..... 110/331, 332; 432/247

[56] References Cited

U.S. PATENT DOCUMENTS 2,843,372 7/1958 Edwards ..... 432/247
3,260,228 7/1966 Lingl ..... 110/332
3,429,562 2/1969 Hewlett, Jr. ..... 110/331 X
4,081,236 3/1978 Corbett ..... 110/331 X
4,421,480 12/1983 Tokitsu et al. ..... 432/247

*Primary Examiner*—Edward G. Favors
*Attorney, Agent, or Firm*—Wenderoth, Lind & Ponack

[57] ABSTRACT

A furnace crown structure for furnaces used to fire ceramic materials at high temperature, which comprises silicon carbide beams.

Each beam is laid crosswise to the longitudinal axis of the furnace, parallel to one another at constant pitch distances apart. The spaces between the beams one closed with satisfactory material plates.

The furnace affords the possibility of forming a furnace crown from a light weight material which can provide for a rapidly achieved steady state operation and cooling down of the furnace.

The furnace can reach temperatures in the 1600° C. range.

5 Claims, 4 Drawing Figures

SUPPORTING STRUCTURES FOR FURNACE CROWNS

BACKGROUND OF THE INVENTION

1. Field of the Invention

This invention relates to a supporting structure for furnace crowns, which structure is specially, but not exclusively, suitable for use with furnaces operated at high temperatures.

Known in the art are several methods of constructing furnace crowns, from the traditional vault type which has in its commonest form a semicircular section resting on two sidewalls. This is a set-up which has been known from ancient times and is still largely used on account of its reliability with time. However, that construction involves considerable investment costs both as regards the amount of material it requires and the complexity of its installation. The crown, in fact, must have a considerable thickness dimension and the furnace sidewalls which support the crown must be adequately sized to bear its weight. The enormous mass involved, additionally to raising the plant cost, also brings about increased operating costs, especially in connection with the furnace lighting and extinguishing steps. In such circumstances, in fact, the agent thermal capacity of the furnace load bearing structures unavoidably requires consumption of large amounts of energy before the desired operating temperature can be reached. Likewise when the furnace is to be put off for servicing purposes, a long time is expended in waiting for the furnace structures to cool down and permit access to the inner systems. This is true of continuous operation furnaces but grows in importance in the instance of discontinuous operation furnaces.

Furthermore, vault furnaces of this type, being generally lined with a refractory material of a standard variety, are liable, when operated at high temperatures, to surface pulverization of the lining material. The powder which comes off the furnace crown is dropped onto the material being fired and aggravates the finished product faults, with a consequent increase of rejects.

Also known are other methods of covering the furnace upper portion, such as by metal structures for supporting the insulating refractory portion thereof. Such structures, however, in order to withstand high temperatures, must be provided with a forced ventilation system. This involves, first of all, an increase in energy costs for thermal dispersion due to cooling by forced ventilation, and secondly, a sudden electric power outage due to incidental causes would stop the forced ventilation and result in sudden overheating of the metal portion of the furnace crown and evident risk of consequent collapsing.

2. Prior Art

It is a primary object of this invention to obviate such prior drawbacks by providing a structure which affords the possibility of forming a furnace crown from a lightweight, high temperature resisting material.

Another object of this invention is to provide for a rapidly achieved steady state operation and cooling down of the furnace. It is a further object of the invention to provide a a furnace crown structure which can be quickly erected at a reduced cost.

A not unimportant object of the invention is to provide a furnace which can reach temperatures in the 1,600° C. range.

These and other objects are achieved by a furnace crown according to the invention, for high temperature firing ceramic materials, characterized in that it comprises silicon carbide beams, said beams being laid cross wise to the longitudinal axis of the furnace; said beams being laid parallel to one another at constant pitch distances apart; and the spaces defined between said beams being closed with refractory material plates.

Advantageously, said beams have a flat rest surface adapted to receive said plates.

SUMMARY OF THE INVENTION

Further features and advantages will be more readily understood from the following detailed description of a structure according to the invention, with reference to the accompanying illustrative drawings, where:

DETAILED DESCRIPTION OF THE PREFERRED EMBODIMENT

Figure 1:
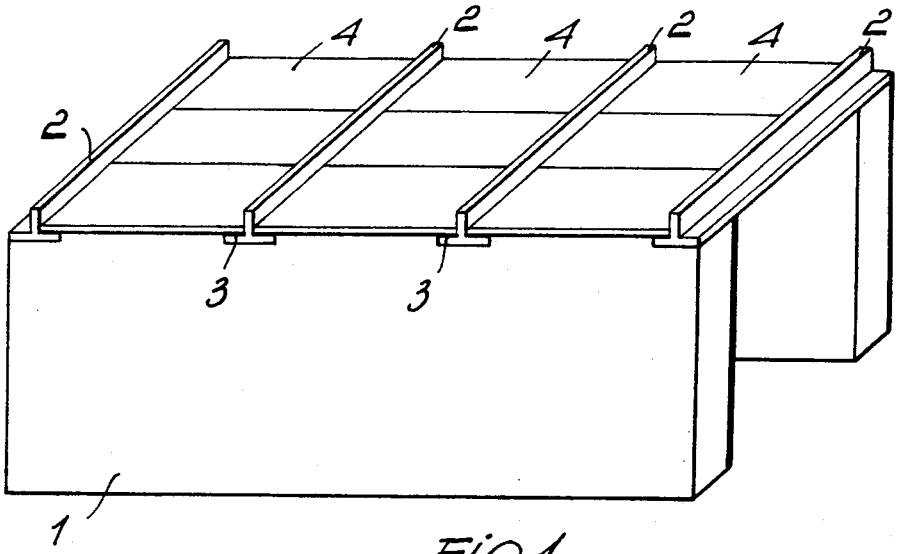
FIG. 1 is a perspective view of a furnace crown according to the invention.

The reference numeral 1 designates the furnace sidewalls which support the silicon carbide beams 2. Said beams have, in the exemplary embodiment of FIG. 1, an inverted "T" cross-sectional shape. Said beams support, through the flat rest surface 3, the plates 4 which cover the space included between any two adjoining beams.

Figure 2:
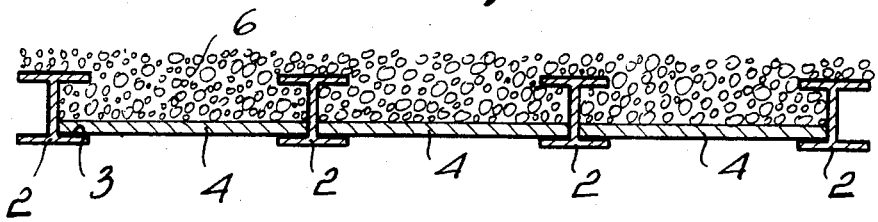
FIG. 2 is a vertical section view of the crown taken along the furnace longitudinal axis.

In FIG. 2, the furnace crown thus formed is completed with a lining of a low density refractory material having good thermal insulation properties. In the illustrative example of FIG. 2, I-like shaped beams have been used.

Figure 3:
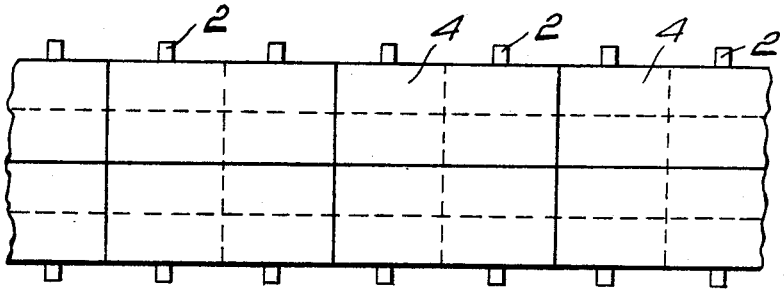
FIG. 3 is a plan view of the crown, wherefrom the furnace peripheral masonry work has been omitted for clarity of illustration.
Figure 4:
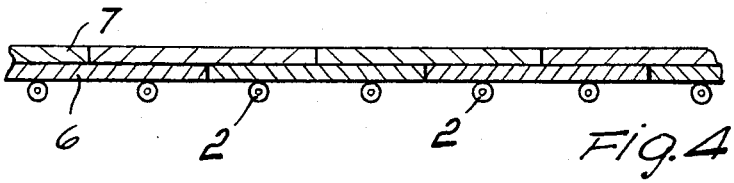
FIG. 4 is a vertical section view of the crowns taken along the furnace longitudinal axis, in accordance with one of the invention possible embodiments.

FIGS. 3 and 4 show another embodiment of the same inventive idea, wherein the plates 4 are arranged in two overlapping layers such that the joints between plates of the lower layer 6 are covered by plates in the upper layer 7. In the plan view of FIG. 3, the lower layer plates are shown in ghost lines, whereas the upper layer plates are shown in full lines.

FIG. 4 shows how, in this embodiment, tubular cross-section beams may be utilized.

Of course, the crown according to this modified embodiment may also be thermally insulated by means of a low density refractory material. Expediently, said insulating material would comprise two layers, the lower whereof features high temperature resisting properties and may be formed, for example, from either cordierite or alumina-based materials, whereas the upper layer comprises expanded clay.

The crown according to this embodiment may include a first layer of refractory materials having a small thickness dimension so as to have no thermal mass, followed by a second layer of ceramic fiber.

This would obviate the problems encountered by some manufacturers in providing crowns formed from ceramic fiber throughout, such as downfall of powder onto the material and consequent declassing thereof, and absorption by the crown material of the enamel vapors released within the furnace, with attendant damage and decreased durability.

According to a further embodiment of the invention, more than one plate layer may be provided and each layer would be suitably spaced apart from the preceding one by means of ceramic material spacers, e.g. in the form of small hollow cylinders, so that spaces are formed between horizontally laid and spaced apart layers which serve a thermal insulation function. Such spaces may be left void or filled with a low density insulating refractory material.

I claim:

1. A furnace crown structure for furnaces used to fire ceramic materials at a high temperature, characterized in that it comprises silicon carbide beams:

said beamms being laid crosswise to the longitudinal axis of the furnace;

said beams being laid parallel to one another at constant pitch distances apart; and the spaces defined between said beams being closed with refractory material plates.

2. A furnace crown structure according to claim 1, wherein said beams have a flat rest surface adapted to receive the ends of said plates.

3. A furnace crown structure according to claim 1, wherein said crown is covered with a low density thermally insulating ceramic material.

4. A furnace crown structure according to claim 3, wherein said low density thermally insulating ceramic material comprises two layers, the lower of said layers having high temperature resisting properties and the upper of said layers being formed from expanded clay.

5. A furnace crown structure according to claim 1, wherein said spaces are closed by at least two overlapping and closely adhering layers of plates, such that the joints between plates in the lower layer are covered by the plates in the upper layer.

* * * * *